United States Patent [19]

Laganowski

[11] Patent Number: 5,074,594

[45] Date of Patent: Dec. 24, 1991

[54] SUPERMARKET PRICE TAG SYSTEM

[76] Inventor: Dorothy Laganowski, 704 Whitpain Hills, Center Square, Pa. 19422

[21] Appl. No.: 535,641

[22] Filed: Jun. 11, 1990

[51] Int. Cl.[5] ..... G09F 3/18

[52] U.S. Cl. ..... 283/81; 40/638; 40/657

[58] Field of Search ..... 283/81; 40/645, 638, 40/299, 637

[56] References Cited

U.S. PATENT DOCUMENTS

| | | | |
|---|---|---|---|
| 1,808,292 | 6/1931 | Coppersmith | 40/645 |
| 2,845,728 | 8/1958 | Huber | 40/638 |
| 3,211,470 | 10/1965 | Wilson | 283/81 |
| 3,501,365 | 3/1970 | Marshall | 283/81 |
| 3,993,814 | 11/1976 | Cavender | 283/81 |
| 4,260,656 | 4/1981 | Mullen | 283/81 |
| 4,335,172 | 6/1982 | Sato | 283/81 |
| 4,519,631 | 5/1985 | Stone et al. | 283/70 |
| 4,531,313 | 7/1985 | Fast | 40/657 |
| 4,534,125 | 8/1985 | Buck | 40/645 |
| 4,627,641 | 12/1986 | Kawaguchi | 283/81 |
| 4,725077 | 2/1988 | Fujita | 283/67 |
| 4,795,196 | 1/1989 | Hyun et al. | 283/67 |
| 4,842,304 | 6/1989 | Jones | 283/81 |
| 4,865,351 | 9/1989 | Smithson et al. | 283/58 |

OTHER PUBLICATIONS

"Coding Labels" by Dennison, Jacobs Gardner Office Product, p. 741, 1988.

*Primary Examiner*—Douglas D. Watts
*Assistant Examiner*—Hwei-Siu Payer
*Attorney, Agent, or Firm*—Stuart E. Beck

[57] ABSTRACT

A price tag system comprising a shelf, a price tag supporting bracket mounted on the shelf and a price tag supported by the bracket. The price tag comprises a plurality of zones. One of the zones comprises an image of the article to which the price tag corresponds, and the other zone comprises a location in which a pricing label can be attached.

Another aspect of the invention relates to a price tag system comprising a price tag comprising a plurality of zones where one of the zones comprises an image of an article to which the price tag corresponds, and the other zone comprises a location in which a pricing label can be mounted.

A further aspect of the invention comprises a peelable label system for use as a price tag comprising a substrate with a plurality of labels which are peelably connected to t he substrate. Each label comprises two portions. The portions are of different size. They may be of different color. One portion is for receiving indicia relating to the price of the article. The other portion is for receiving unit pricing with respect to the article.

12 Claims, 1 Drawing Sheet

FIG. 1
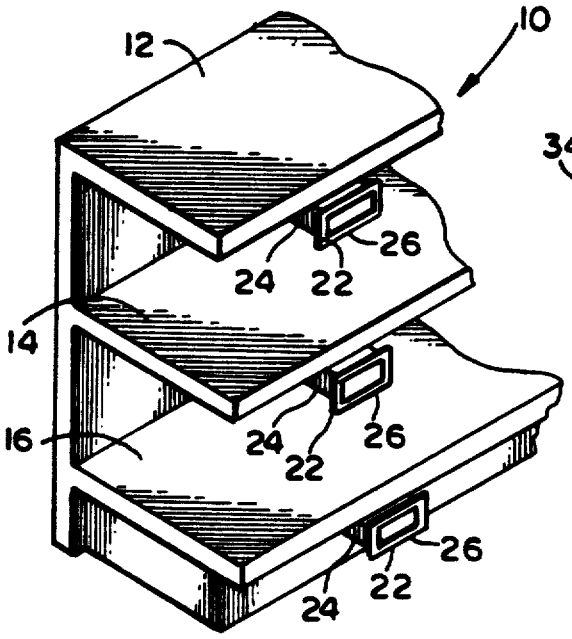
FIG. 2
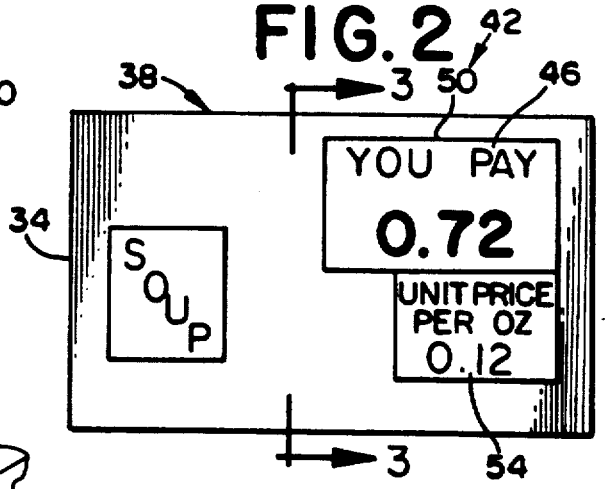
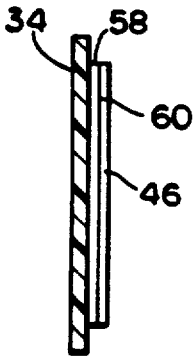
FIG. 3
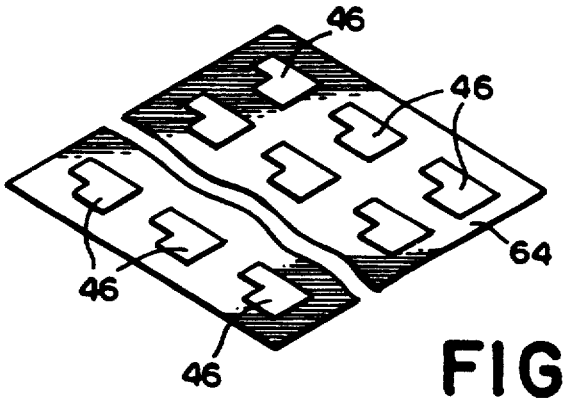
FIG. 4
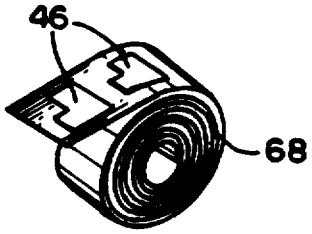
FIG. 5

SUPERMARKET PRICE TAG SYSTEM

BACKGROUND OF THE INVENTION

This invention relates to a supermarket price tag system and more particularly to a system where an image of the article which is on the shelf appears on the price tag and wherein the price of the article can be changed without replacing the entire price tag.

Many supermarkets have price tags on the shelves adjacent to the articles to which they correspond. Their purpose is to enable consumers to quickly and easily determine the total price of the article and its unit price, i.e., the cost per pound or per ounce. The unit price enables a consumer to compare the relative cost of similar items which are packaged in different quantities.

However, these tags suffer from several deficiencies. Thus, it is often difficult to ascertain precisely which article the tag relates to. Further, if a person has poor eyesight, or is not familiar with the English language, then the price tag is of no value.

Additionally, whenever the price of the article or its size changes, it is necessary for the tag to be removed and replaced by another tag showing the new article price and unit price. Still further, it is often difficult for the customer to determine which of the prices on the tag is the unit price, and which is the price of the article. This is because both prices appear in a uniform size. Thus, they cannot be distingushed unless are studied closely.

It would be desirable to have a price tag system for a store shelf which is permanently mounted on the shelf and which has readily replaceable pricing information. Preferably, such a pricing system would comprise a tag made of a rigid thermoplastic mounted on a frame which was permanently connected to the shelf.

The tag would have an image of the article to which it corresponded mounted directly on it with the pricing information placed on labels which were adhesively bonded to the tag. Thus, if the pricing of the article should change, the existing label could be peeled from the tag and a new label with the new pricing information installed.

SUMMARY OF THE INVENTION

Briefly, the invention relates to a price tag system adapted to be mounted on shelving comprising a shelf with a price tag supporting bracket connected to it. A price tag is supported by the bracket. It includes an image of the article to which the price tag corresponds and a peelable label on which the price of the article and the unit price of the article can be placed.

A further aspect of the invention relates to a price tag system comprising a price tag and an image of the article to which the price tag corresponds, and the cost of the article and its unit price on separate portions of a peelable label.

Still further, the invention relates to a peelable label system for use on a price tag which comprises a substrate on which are adhesively connected a plurality of labels where each of the labels comprises two zones of different sizes where one of the zones is adapted to receive the price of an article, and the other of said zones is adapted to receive the unit price of the article.

BRIEF DESCRIPTION OF THE DRAWING

The invention will be better understood and further advantages and the uses thereof will be readily apparent when considered in view of the following detailed description of an exemplary embodiment, taken with the accompanying drawing in which:

FIG. 1 is a prespective view of a shelving rack showing the proposed invention in its operating environment.

FIG. 2 is a plan view of a price tag constructed in accordance with a presently preferred form of the invention.

FIG. 3 is a section view taken along line 33 of FIG. 2.

FIG. 4 is a prespective view of a plurality of labels constructed in accordance with the presently preferred form of the invention mounted on a rectangular sheet.

FIG. 5 is a perspective view of a plurality of labels constructed in accordance with the presently preferred form of the invention mounted on a rolled strip.

Referring to FIG. 1, a shelving system 10 on which the proposed price tag system is to be used is seen. The shelving system 10 comprises a plurality of horizontally extending shelves 12, 14 and 16.

At spaced locations along the shelving, at places that correspond to the placement of articles on the shelves are mounted a plurality of brackets 22. Each bracket comprises a member 24 by which it is connected to the shelf and a generally rectangular frame 26.

A price tag 34 is supported in each rectangular frame 26.

As seen in FIG. 2, each price tag 34 may be a generally rectangular member whose dimensions may be approximately 2 inches by 3 inches. The price tags 34 may be made of a suitable plastic and may be permanently mounted in the frames 26.

Each price tag comprises at least two zones, namely, an image zone 38 and a pricing zone 42. Preferably, zones 38 and 42 are displaced laterally from each other by a distance sufficiently large enough to permit inclusion of bar coding information and the like.

As seen in FIG. 2, the image zone 38 contains an image of the article on the shelf to which it corresponds. Thus, the image of a container of a particular brand and size soup would be illustrated on the price tag 34 adjacent to the shelf location for that brand and size soup.

The pricing information would appear on a label 46 peelably mounted on the price tag in the pricing zone 42.

The label 46 comprises two portions. The first portion 50 is an enlarged rectangular element with its principal dimension extending horizontally when supported by the price tag 38. Attached to it is a second portion 54. The second portion 54 may also be a rectangular element with its principal dimension extending horizontally. Preferably, the second portion 54 of the label 46 is an extension of the lower edge of the first portion 50 and is disposed to one side of the first portion 50 so that the label has a generally "L" shaped appearance.

Preferably, the larger first portion 50 is for receiving indicia corresponding to the retail price of the article whose image appears in image zone 38 while the second portion 54 is for receiving indicia corresponding to the unit price if the article in cost per pound, per ounce or the like.

Further, if desired the first portion 50 and the second portion 54 may be different colors to make their purposes more readily apparent to the consumer. Thus, the first portion 50 could be white while the second portion 54 could be red or orange.

The indicia may preferably be black so that it will readily stand out in both portions 50 and 54.

As seen in FIG. 3, each of the labels 46 has a layer of adhesive 58 attached to its rear surface 60 so that it can be peelably connected to the price tag 34.

Referring to FIG. 4, a plurality of peelable labels 46 are shown attached to a substrate comprising a rectangular sheet 64 having a surface which will easily permit the labels 46 to be peeled therefrom so that they can be adhesively and peelably attached to the price tag 34.

In FIG. 5 the labels 46 are shown attached to a substrate comprising a strip of material similar to that illustrated in FIG. 4. However, in this instance it is coiled into a roll 68.

The invention is used by merely mounting the brackets 22 on a shelf adjacent to the articles to which they are to correspond. The price tags may have the images of the articles permanently imprinted on them, or they may be attached by a suitable adhesive. The labels 46 are prepared by applying indicia that corresponds to the price of the article and the unit price to the respective portions 50 and 54. The labels are then peeled from the rectangular substrate (FIG. 4) or the strip (FIG. 5) and attached to the pricing zone 42 of the price tag 34. Because the two portions 50 and 54 of the label are different sizes and different colors, consumers will be greatly assisted in determining which price is the unit price and which is the price of the article.

When the price of the article changes, it will not be necessary to remove and dispose of the entire price tag. All that need be done is to peel the label 46 and to replace it with a new label 46 with the new pricing information.

While the invention has been described with respect to a particular embodiment, it is apparent that other embodiments can be employed to achieve the intended results. Thus, the scope of the invention should not be limited by the foregoing description, but, rather only by the scope of the claims appended hereto.

I claim:

1. A price tag system adapted to be mounted on shelving comprising a shelf, a price tag supporting bracket mounted on said shelf, a price tag supported by said bracket, said price tag comprising a plurality of zones, one of said zones including an image of an article to which said price tag corresponds, a second of said zones of said price tag comprising a location for pricing information for the article in said image, said one zone and said second zone being displaced laterally from each other, a label, means for releasably mounting said label on said second zone of said price tag, said label comprising at least two rectangular portions, one of said portions having indicia relating to the retail price of the article in said image, and another of said portions having indicia relating to the unit price of the article in said image.

2. A price tag system as defined in claim 1 wherein said portions of said label are of different sizes so that said label has an "L" shaped appearance.

3. A price tag system as defined in claim 2 wherein said portions of said label are of different colors.

4. A price tag system as defined in claim 3 wherein said price tag is comprised of rigid thermoplastic.

5. A price tag system comprising a price tag, said price tag comprising a plurality of zones, one of said zones including an image of an article to which said price tag corresponds, a second of said zones of said price tag comprising a location for pricing information for the article in said image, said one zone and said second zone being displaced laterally from each other, a label, means for releasably mounting said label on said second zone of said price tag, said label comprising at least two portions, one of said portions having indicia relating to the price of the article in said image.

6. A price tag system as defined in claim 5 wherein said portions of said label are of different sizes so that said label has an "L" shaped appearance.

7. A price tag system as defined in claim 6 wherein said portions of said label are of different colors.

8. A price tag system as defined in claim 7 said price tag is comprised of rigid thermoplastic.

9. A peelable label system for use on a price tag comprising a substrate, said substrate being comprised of a relatively stiff material and having a surface which will releasably retain an adhesive, a plurality of labels, each of said labels having first and second surfaces, one of said surfaces comprising a peelable adhesive and the other surface being adapted to receive pricing indicia, and each of said labels comprises first and second rectangular portions, one of said portions being for receiving the price of an article, and another portion being for receiving the unit price of said article, said portions of said label being of different sizes so that said label has an "L" shaped appearance, and said labels are peelably connected to said substrate surface that releasably retains said adhesive.

10. A peelable label system as defined in claim 9 wherein said portions of said label are of different colors.

11. A peelable label system as defined in claim 10 wherein said substrate comprises an elongated narrow strip and said labels are disposed along said strip.

12. A peelable label system as defined in claim 10 wherein said substrate comprises a rectangular sheet and said labels are disposed along said sheet.

* * * * *